United States Patent [19]

Gray et al.

[11] Patent Number: 4,701,126

[45] Date of Patent: Oct. 20, 1987

[54] ELEVATED TEMPERATURE DEHYDRATION SECTION FOR PARTICLE DRYING PULSE JET COMBUSTION SYSTEMS

[76] Inventors: Robert R. Gray, 7110 Via Monte Mar, Gladstone, Oreg. 97027; Thomas G. Lindahl, 7325 SW. Mallard Ct., Portland, Oreg. 97223

[21] Appl. No.: 783,856

[22] Filed: Oct. 3, 1985

[51] Int. Cl.[4] ..... F27B 15/00; B01D 1/16; F23C 11/04; F27D 7/00

[52] U.S. Cl. ..... 432/58; 159/4.02; 159/4.03; 431/1; 432/25

[58] Field of Search ..... 432/14, 25, 58; 431/1; 159/4.02, 4.06, 4.03

[56] References Cited

U.S. PATENT DOCUMENTS 2,838,869 6/1958 Desbenoit et al. ..... 239/587 X 3,133,805 5/1964 Robinson ..... 432/58

*Primary Examiner*—John J. Camby

[57] ABSTRACT

Improved construction for the dehydration sections of pulse jet combustors for the drying of particulate materials including provisions for maintaining the surface of the downstream end thereof at elevated temperatures.

4 Claims, 3 Drawing Figures

10
10'
12
14
16
18
20
22
24
26
28
30
32
34
36
40
42
44
46
48
50
52
54
56
58
60
62
64
66
68
70
72
74
76
78
84
116

ELEVATED TEMPERATURE DEHYDRATION SECTION FOR PARTICLE DRYING PULSE JET COMBUSTION SYSTEMS

This invention relates to the drying of particulate material and more particularly to improved methods and apparatus for the pulse combustion drying of particulate material.

BACKGROUND OF THE INVENTION

Pulse combustion drying, employing a pulse combustor essentially similar in nature to a pulse jet engine, is a relatively recent but recognized technique for effecting the drying of particulate materials. Illustrative of some earlier endeavors in pulse jet field for drying and other purposes are U.S. Pat. Nos. 3,618,655; 4,226,668; 4,226,670; 4,265,617 and 2,838,869. In the first of these patents a plurality of pulse jet engines are mounted at the base of a vertical chamber. A paste or slurry of the particulate material to be dried is introduced into the exhaust duct of such pulse jet engines which function to at least partially dry the particulate material and introduce it into the chamber where induced vortex gas flow causes circulation of the particulate material and consequent opportunity for further drying thereof. In the latter of these patents a linear pulse jet engine assembly for projecting various types of materials is disclosed.

A current state of the art pulse combustion dryer is made and sold by Sonodyne Industries of Portland, Oreg. The pulse combustor unit, which is the heart of the drying system, is a specially contoured and generally U-shaped hollow tube whose dimensions and materials of construction determine its operation. The pulse combustion process is initiated when air and fuel from a constant low pressure supply thereof are drawn into the combustion chamber portion of the combustor and ignited by a spark. Hot gases created by the resulting detonation move in both directions from the combustion chamber. In one direction, they pass through an air inlet conduit and adjacent air augmenter, and in the other direction, through a U-shaped exhaust section and past a raw material injection port at the downstream end thereof. Detonation in the combustion chamber causes the pressure therein to rise, momentarily shutting off the fuel supply. As the combustion chamber pressure falls following detonation, fuel is again admitted and mixed with air being drawn through the inlet conduit. Detonation occurs again, either because of contact between the explosive air-fuel mixture and the spark or by contact with the sufficiently hot wall of the chamber itself. Once the wall temperature reaches approximately 1800° F., the spark can be extinguished and the process becomes self-igniting.

The pressure fluctuation, which causes the pulsing behavior of the combustor, results in strong standing waves of sound energy which move in both directions from the chamber. Repeated detonations also create high speed displacement of hot gases with about 90% thereof exiting through the tailpipe and associated exhaust system components. Introduction of moisture laden particulate material into the downstream end of the exhaust sections subjects such material to the sound waves which, although not fully understood, are believed to break the bonds between the solid particulate matter and the liquid, most often water, and in an atomization of the water into fine droplets with a consequent increase in surface area for evaporation. The heat present in the exhaust gas interacts with the atomized cloud of introduced raw material allowing highly efficient evaporation to occur. During drying, the rapid evaporation of the water absorbs most of the heat and the solid particulates are maintained and exit in a relatively cool state. It should be noted that while operating temperatures in the pulse combustion exhaust system exceed 2500° F., the residence time of the raw product solids in contact with the exhaust gases is very short, being in the order of a few milliseconds. Because of such short residence time and the high heat consumption effected by evaporation, the temperature of the dried solid particulates rarely exceeds 100° to 150° F.

While pulse combustor drying apparatus of the type described immediately above has proved to be both efficient and economical in the drying of many diverse materials, certain problems have been encountered in the drying of particular materials. One such problem has been the undesired accumulation and build up of dried or partially dried particulates at the downstream end of the drying cone. Such accumulation, which appears sporadically but builds up rapidly when it occurs, mainly seems to occur with materials of high alkalinity such as drilling mud, brewers yeast and certain resins.

SUMMARY OF THE INVENTION

This invention may be briefly described as an improved construction for pulse combustion drying apparatus and which includes, in its broad aspects, method and apparatus for minimizing, if not avoiding, undesired sticking of particulate material at the downstream end of the drying cone by maintaining the inner surface thereof at elevated temperatures. In its narrower aspects the subject invention includes the maintaining of the inner surface of the downstream end of the drying cone at elevated temperatures through selective application of heat thereto, either through an external source of heat or by utilization of the elevated temperature of a portion of the combustor exhaust gas itself.

The object of this invention is the provision of methods and apparatus for minimizing, if not avoiding, undesired particulate accumulation of the downstream end portion of the drying cone for pulse combustor drying apparatus by maintaining the same of elevated temperatures.

Other objects and advantages of the subject invention will be apparent from the following portions of this specification and from the appended drawings which illustrate, in accord with the mandate of the patent statutes, a presently preferred construction for a pulse combustor drying apparatus incorporating the principles of this invention.

Figure 1:
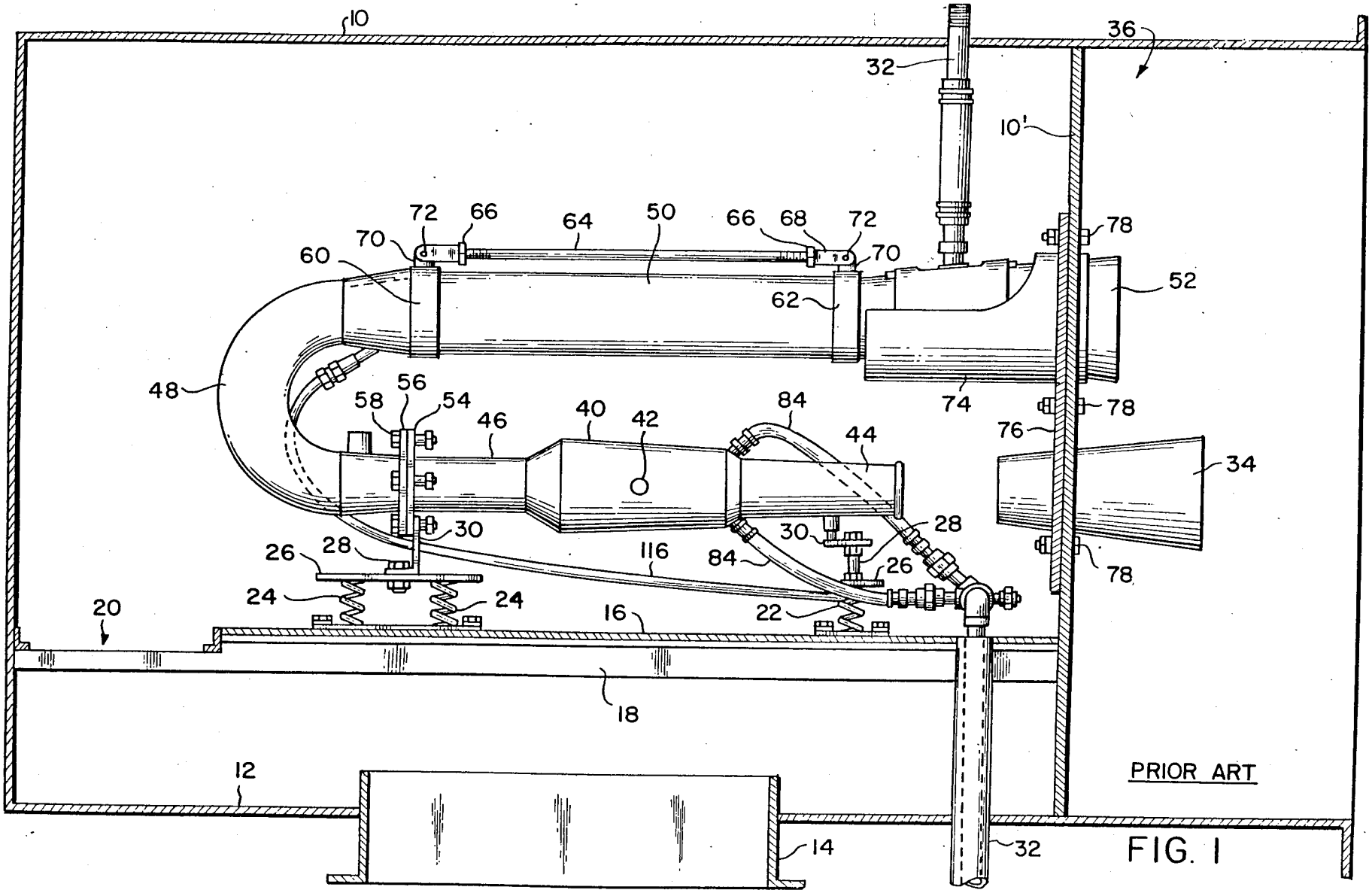
PRIOR ART FIG. 1
FIG. 1 is a schematic side elevation of a pulse combustor drying system.

Referring initially to FIG. 1, a conventional type of combustor dryer system as there depicted broadly includes an isolating enclosure 10, desirably of double walled sound-proof character, having an air inlet conduit 14 on the bottom wall 12 thereof. Disposed within the enclosure 10 is a platform 16 supported on beams 18 in uniform spaced relation to the enclosure bottom wall 12 and generally forming an inlet air plenum therebetween. The rearward end of the platform 16 terminates short of the rear wall of the enclosure 10 to provide a large opening 20 for the passage of air upwardly from the air inlet conduit 14.

Also as illustrated, the pulse jet combustor is mounted in a resilient manner above the support platform 16 so as to cushion the platform and enclosure walls from vibrations incident to the operation of the combustor. Resilient mountings such as a front coil spring 22 and a rear pair of coil springs 24 extend upward from the platform 16, and support mounting plates 26 at their upper ends. Bolts 28 secured removably to the plates 26 serve to secure thereto brackets 30 which connect to and serve to support the front and rear portions of the combustor.

The pulse jet combustor includes a combustion chamber 40 of enlarged diameter provided with a spark plug 42 or other ignition means for igniting a combustible fuel-air mixture. Connected to the combustion chamber 40 is an air inlet conduit 44 which receives atmospheric air from within the enclosure 10, and a combustion gas outlet conduit generally shown at 46.

The combustion gas outlet conduit 46 communicates through an arcuate and generally U-shaped coupling section 48 with a tailpipe 50 which, in turn, communicates at its downstream or exhaust outlet end with a material dehydration section 52.

In the illustrated embodiment, the combustion gas outlet conduit 46 of the combustion chamber section 40 is provided at its downstream or outlet end with a peripheral flange 54 arranged for removable connection to a corresponding flange 56 at the adjacent upstream or inlet end of the U-shaped coupling or transition section 48, as by means of a plurality of bolts 58. The downstream end of the coupling section 48 is fitted with an outwardly and forwardly projecting annular collar 60 dimensioned to freely receive therein the adjacent upstream end of the tailpipe section 50.

The downstream end of the tailpipe section 50 is, in similar manner, freely received within an enlarged collar 62 secured to and extending rearwardly of the upstream end of a dehydration section 52 in the form of a hollow truncated cone and generally called a "drying cone". To facilitate tailpipe replacement the collars 60 and 62 are interconnected by a turnbuckle assembly which includes an elongated threaded rod 64 received at its opposite ends in threaded nuts 66. Each nut is secured to a pair of laterally spaced lugs 68 which receive between them an ear 70 extending upwardly from the associated collar. Registering openings in the lugs and ears receive a pivot pin 72 for joining them together.

The dehydration section 52, which is of elongated frusto-conical shape and will be hereinafter referred to as a dehydration or drying cone, extends through a mounting plate 76, removably secured to a wall of 10' of the enclosure, as by bolts 78. As is apparent, the dehydration cone 52 terminates within an adjacent large volume collector room 36 wherein the majority of the dried particulates settle out and are collected in any suitable manner. A dust collector or other conventional particulate collecting device is usually connected to the gas exhaust system for such collecting chamber or room 36 to effect recovery of substantially all of the dried particulates.

A wet product inlet conduit 32 is connected to the dehydration cone 52 for introduction of the wet product into the cone in a direction substantially perpendicular to the direction of movement of the high velocity gases of combustion passing through the tailpipe and exiting from the downstream end of the dehydration cone 52.

Combustible fuel, such as oil, gas, etc. is delivered to the combustion chamber 40 by one or more fuel supply lines, such as the two lines 84 illustrated, connected to the fuel inlet conduit 32.

The plate 76 supporting the dehydration cone saddle 74 also supports a so called "augmenter" in the form of a hollow truncated cone 34 disposed in spaced axial alignment with the air inlet portion 44 of the combustion chamber 40 and which also extends through the forward engine room wall 10'. In the described system, the augmenter 34 functions to direct the high velocity combustion gases emitted as back flow from the combustion chamber 40 and air inlet conduit 44 into the adjacent collector room 36.

In the operation of the above described pulse combustor system, the combustor is activated by delivery of combustible fuel and air to the combustion chamber 40 where it is ignited by a spark from the plug 42. A wet product in the form of a slurry, paste or moist particulate is fed, generally under pressure, through the material inlet conduit 32 from whence it enters the dehydration cone 52 in a direction substantially perpendicular to the direction of flow of high velocity combustion gases through the dehydration cone 52.

While, as noted earlier, operation of pulse combustor drying apparatus of the type described above has proved to be both efficient and economical in the drying of many diverse materials, a problem of partially dried material "sticking" to the drying cone surface and a concomitant rapid build up thereof and degradation of combustor operation has been encountered with certain materials. Such "sticking" and material build up always appears to occur in the "low velocity" area at the exit end of the dehydration cone 52.

Figure 2:
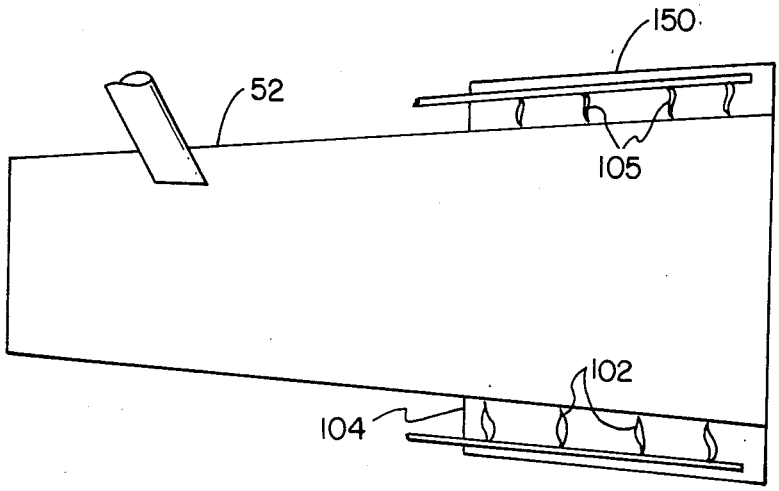
FIG. 2 is an enlarged vertical section of an improved construction of one embodiment of a dehydration cone construction incorporating the principles of this invention.

Referring now to FIG. 2, there is shown, on an enlarged scale, a dehydration cone 52 of generally frusto-conical configuration and of a continually expanding diameter in the direction of exhaust gas flow. In pulse combustor dryers of the type herein of interest, the temperature of the exhaust gas stream at the entry side of the drying cone will normally be in the range of about 2000° to 3000° F. As previously pointed out, the highly efficient atomization of the introduced wet material and rapid evaporation of the water content thereof results in a drop in the exhaust gas stream temperature to about 200° to 300° F. at the exit end of the drying cone 52. Commensurately therewith the temperature of the downstream end of the drying cone 52 itself approximates that of the exhaust gas i.e., about 200°–300° F. In order to elevate the temperature of the downstream end portion of a drying cone 52, externally applied heat is provided as by a ring burner assembly 100 made up of a plurality of inwardly directed gas jets 102 mounted in a sleeve type housing 104. Control of the fuel/air mixture supplying the gas jets 102 permits the temperature of the surfaces of the downstream end of the drying cone 52 to be both substantially raised and also controlled at any desired temperature level. Such localized heat application will not detrimentally affect the basic pulse jet drying phenomena but will function to reduce, if not avoid, detrimental product sticking at the downstream end of the drying cone 52.

Figure 3:
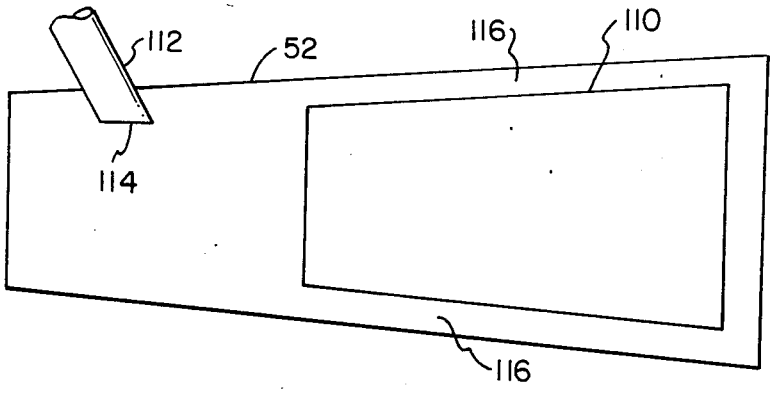
FIG. 3 is an enlarged vertical section of an alternative construction for a dehydration cone incorporating the principles of this invention.

FIG. 3 illustrates an alternative approach for elevating the temperature of the downstream end of a drying cone 52 to reduce detrimental product sticking thereat. As shown in FIG. 3, a second and smaller frusto-conical shell 110 is concentrically mounted within the cone 52 and is sized to extend over a substantial portion of the length thereof, downstream of the locus of raw material introduction 112 with its walls disposed substantially in parallel spaced relation with the walls of the cone 52. In this embodiment, the wet particulate raw material is desirably introduced, as at 114, closely adjacent to the center line of the drying cone 52. Most of the wet raw material emanating therefrom is picked up by the exhaust gas stream and passes through the inner shell 110 where the drying action continues in the manner heretofore described with its attendant drop in exhaust gas temperature. The confinement of the drying operation within the inner shell 110 however permits the passage of a portion of the high temperature exhaust gases through the annulus 116. Since minimal evaporation of the carrier liquid will take place within this portion of the exhaust gas stream, the temperature thereof will remain sufficiently high to maintain the walls of both the drying cone 52 and the inner shell 110 at an elevated temperature and will thus function to reduce detrimental product sticking at the downstream end of the drying cone 52 and shell 110.

We claim:

1. In pulse jet combustor apparatus for the drying of particulate material of the type having a combustion chamber, an air inlet conduit connected to one end thereof a primary exhaust gas outlet conduit connected to the other end thereof, an elongated transition-tailpipe section connected to said primary exhaust conduit, and a frusto-conically shaped drying section of increasing diameter connected to the downstream end of said transition-tailpipe section having means for introducing particulate material to be dried therein, the improvement comprising means for maintaining the surfaces of the downstream end of said frusto-conical drying section exposed to said particulate material at an elevated temperature through localized selective application of heat thereto to reduce particulate stickage on such surfaces.

2. The improved pulse jet combustor apparatus as set forth in claim 1 wherein said last mentioned means comprises a plurality of gas jets mounted in surrounding relation to the downstream end portion of said drying cone.

3. The improved pulse jet combustor apparatus as set forth in claim 1 wherein said last mentioned means includes a frusto-conically shaped shell disposed concentrically within the downstream end of said drying cone and in spaced relation thereto to define a peripheral annulus accommodating a flow of high temperature exhaust gas therepast.

4. In the operation of pulse jet combustor apparatus for the drying of particulate material through introduction of wet particulate material into a stream of temperature combustor exhaust gas in a conical conduit, the step of reducing sticking of particulates to the inner walls of said conical conduit by maintaining the downstream end portions thereof at localized elevated temperatures.

* * * * *